United States Patent [19]

Hoover

[11] Patent Number: 4,673,946

[45] Date of Patent: Jun. 16, 1987

[54] RIDGED WAVEGUIDE TO RECTANGULAR WAVEGUIDE ADAPTOR USEFUL FOR FEEDING PHASED ARRAY ANTENNA

[75] Inventor: John C. Hoover, Roswell, Ga.

[73] Assignee: Electromagnetic Sciences, Inc., Norcross, Ga.

[21] Appl. No.: 809,175

[22] Filed: Dec. 16, 1985

[51] Int. Cl.[4] ..... H01Q 13/00; H01P 1/165

[52] U.S. Cl. ..... 343/776; 333/21 A; 333/34; 333/254; 343/786

[58] Field of Search ..... 333/21 R, 21 A, 34, 333/33, 248, 254; 343/727, 729, 770, 771, 776, 786

[56] References Cited

U.S. PATENT DOCUMENTS

| | | | |
|---|---|---|---|
| 2,129,714 | 9/1938 | Southworth . | |
| 2,706,278 | 4/1955 | Walker . | |
| 2,802,991 | 8/1957 | Coale . | |
| 2,942,261 | 6/1960 | Jones et al. | 333/21 R X |
| 2,946,972 | 7/1960 | Hunt et al. . | |
| 2,975,383 | 3/1961 | Seling | 333/21 A |
| 2,981,904 | 4/1961 | Ajioka et al. . | |
| 3,157,845 | 11/1964 | White . | |
| 3,349,346 | 10/1967 | Enderby . | |
| 3,528,041 | 9/1970 | Honda et al. . | |
| 3,725,824 | 4/1973 | Woodward . | |
| 3,835,423 | 9/1974 | Parisi | 333/34 X |
| 3,918,010 | 11/1975 | Marchalot . | |
| 3,995,238 | 11/1976 | Knox et al. . | |
| 4,222,017 | 9/1980 | Foldes . | |
| 4,293,829 | 10/1981 | Schuegraf . | |
| 4,311,973 | 1/1982 | Nuding et al. . | |
| 4,531,131 | 7/1985 | Monser | 343/786 |

*Primary Examiner*—Paul Gensler

*Attorney, Agent, or Firm*—Nixon & Vanderhye

[57] ABSTRACT

A compact adaptor is provided for making transition from ridged waveguide to rectangular waveguide while simultaneously imparting spatial reorientation of associated electric and magnetic fields. The adaptor is especially useful for feeding a phased array of radiating slots (or other structures) where adjacent radiating structures are preferably spaced from one another on the order of a half wavelength and fed with the magnetic field vectors oriented parallel to such inter-element array spacing dimensions. In the exemplary embodiment, a transition from double-ridged waveguide to rectangular waveguide is effected through an electrically short (e.g., $\frac{1}{8}$th to $\frac{1}{4}$th wavelength) non-resonant cavity using oppositely tapered continuations of the ridged waveguide walls (acting as a TEM parallel transmission line) to opposing walls of a rectangular waveguide port which is spatially oriented transverse to the ridged waveguide.

26 Claims, 8 Drawing Figures

FIG. 2
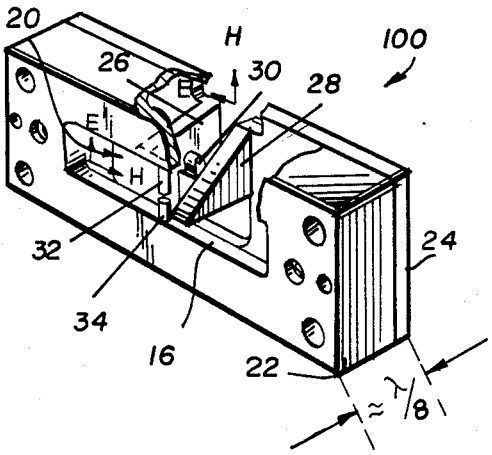
FIG. 3
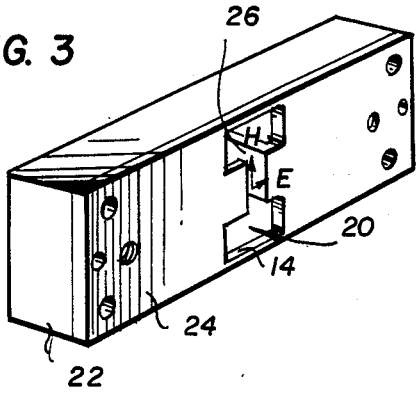
FIG. 6
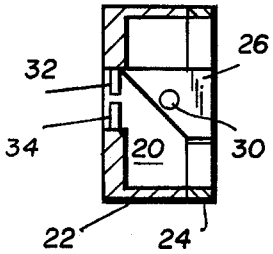
FIG. 4
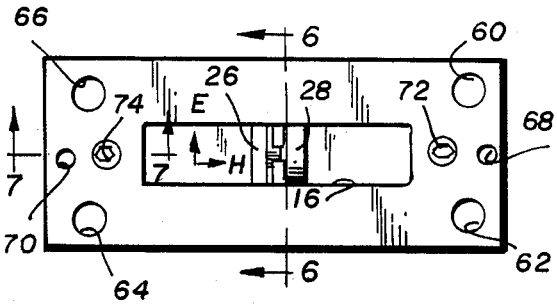
FIG. 5
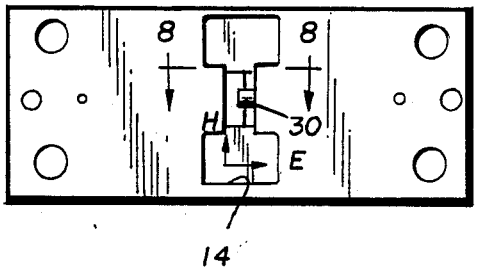
FIG. 1
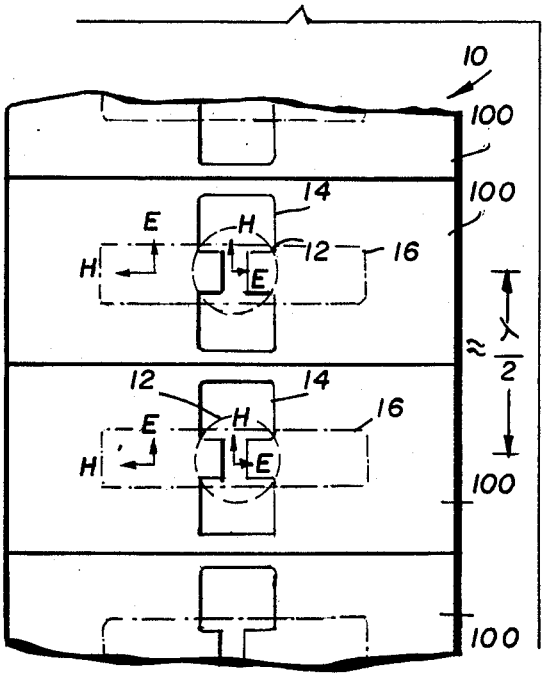
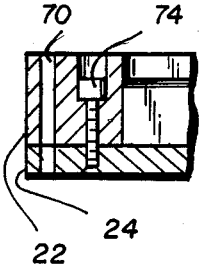
FIG. 7
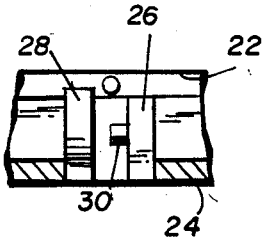
FIG. 8

RIDGED WAVEGUIDE TO RECTANGULAR WAVEGUIDE ADAPTOR USEFUL FOR FEEDING PHASED ARRAY ANTENNA

This invention generally relates to microwave waveguide structures. More specifically, this invention provides a waveguide adaptor which permits a compact transition from ridged waveguide to rectangular waveguide while, if desired, simultaneously imparting a spatial twist (e.g., 90°) to the relative orientation of electric and magnetic field vectors.

Both rectangular and ridged waveguides of various kinds are well known in the prior art. Such single conductor transmission lines are often used for higher RF frequencies. Depending upon the physical internal dimensions of such a waveguide, there is a predetermined "cut off" frequency below which RF waves will not propagate along the structure. Above this cut off frequency, there may be one or more discrete modes of transverse electric (TE) and/or transverse magnetic (TM) propagating electromagnetic radio frequency waves.

Other types of RF transmission structures are also well known in the art. For example, parallel conductor transmission lines are often used to propagate transverse electric and magnetic (TEM) modes of electromagnetic wave propagation. Coaxial transmission lines, microstrip transmission lines, stripline transmission lines, and many variations of these or other types of known transmission lines are also well recognized.

One typical application for RF transmission line structures is to conduct RF energy to/from radiating antenna structures. One type of such known radiating structure may include a phased array of many individual RF radiators which, via various transmission lines structures, emanate to/from a common feed point but with different (sometimes controllable) relative phase relationships. If a two-dimensional phased array is employed, then a "pencil" beam type of radiation pattern may be achieved and the pointing angle of that beam may be determined by the relative phasing between the individual radiators of the array. For a one-dimensional phased array, relatively thin fan beam-shaped radiation patterns can be developed with dimensions, pointing angles, etc. also determined by the relative phasing between the individual radiator elements of the array.

For many reasons, in the design of phased array antennas it is often important to minimize the element-to-element spacing between the individual radiators of the array to the order of half a wavelength or less. For example, such close inter-element spacing may be important to control undesirable grating lobes and/or side-lobes from appearing in the overall radiation pattern of the array.

At higher microwave frequencies, it is common to feed each individual element in the array with a waveguide transmission line. Unfortunately, the longer or broader dimension of the rectangular waveguide must typically be greater than one-half wavelength so as to efficiently support the desired mode of wave propagation within the guide. In a typical dominant $TE_{10}$ mode of rectangular waveguide propagation, the magnetic field vector (i.e., the so-called H-plane) is parallel to the broad or longer dimension of the rectangular waveguide. At the same time, for at least some applications, it is desirable to have the H-plane feed to the radiated structure oriented parallel to the inter-element radiator spacing which, as earlier mentioned, should be on the order of no more than about one-half wavelength. Accordingly, it is physically impossible to properly feed such antenna elements in such an array with traditional rectangular waveguide transmission lines.

On the other hand, it is possible to feed such closely spaced individual radiators with properly oriented magnetic field vectors using more expensive ridged waveguide structures.

I have now discovered a novel waveguide adaptor structure which conveniently permits such individual radiators to be fed with desired magnetic field orientations using ridged waveguide but which is easily transitioned to conventional rectangular waveguide structures spatially rotated by 90° (in the exemplary embodiment) so as to fit within the close inter-element spacings of a typical phased array structure.

In other words, the microwave adaptor of this invention permits one to use ridged waveguide as may be necessary to achieve desired electromagnetic field orientations in the close quarters which may be encountered in feeding individual closely spaced elements of a phased array. The more common rectangular waveguide structures may necessarily be sufficiently large (in at least some dimensions) so as to restrict them from desired spatial positioning at the feed points. Other applications for such an adaptor will also be apparent.

In the exemplary embodiment, a waveguide adaptor changes from a ridged waveguide input/output port (e.g., with its H-plane oriented parallel to the inter-element spacing requirements of a phased array through a very short physical dimension (in terms of electrical wavelength) to a more conventional rectangular waveguide (e.g., having its H-plane oriented perpendicular to the inter-element spacing dimensions of the array). Accordingly, the adaptor not only converts from ridged waveguide to rectangular waveguide, it also accomplishes a substantial "twist" or rotation in the orientation of the propagating electromagnetic field vectors. Although the exemplary embodiment provides an approximately 90° "twist" (which is particularly suited to the context of closely packed feeding structures for a phased array), those skilled in the art will recognize the possibility of suitably modifying the exemplary embodiment so as to achieve different orientations (including possibly no change, a right-handed 90° twist and a left-handed 90° twist to yield a 180° phased differential between selected RF paths or output ports, etc.).

In short, the adaptor of this invention makes it possible to use ridged and/or rectangular waveguide components as may be desired or dictated by particular spatial, cost or other constraints while conveniently connecting these different types of waveguide structures together to form a common RF transmission structure with desired overall mechanical, cost and electrical characteristics.

The exemplary embodiment is constructed with a ridged waveguide port (having a generally H-shaped or I-shaped cross section) providing RF input/output to a non-resonant transition cavity. Oppositely tapered parallel plates are used to continue opposing ridged waveguide walls to connection points on opposite sides of a rectangular waveguide RF input/output port on the opposite side of the non-resonant cavity. The tapered plates operate as a two conductor balanced shielded transmission line (e.g., in the TEM mode) while simultaneously serving to effect a 90° rotation of electric and magnetic field vectors. One or both of the tapered plates may also have an empirically designed impedance matching element (e.g., a short conductive peg) located thereupon and facing the other plate.

After traversing the relatively short non-resonant cavity (e.g., perhaps only $\frac{1}{8}$th of a wavelength in dimension), the narrow or pointed ends of the tapered plates enter a rectangular waveguide input/output port and contact its opposite end walls. In the exemplary embodiment, the width of these ridge extensions tapers from full width (at the ridged waveguide end) to an approximately zero width (at the rectangular waveguide end of the non-resonant cavity). Although a continuous or smooth taper is employed in the exemplary embodiment, discontinuous notches or the like could also be employed to make the transition. In the exemplary embodiment, the rectangular waveguide port also includes a pair of further empirically derived impedence matching elements (the gap therebetween is adjusted for the best impedance match).

The following U.S. patents are presented as examples of possibly relevant prior art which generally relates to RF transmission line structures, impedance matching elements and to adaptors for transitioning between rectangular and ridged waveguide structures:

U.S. Pat. No. 2,946,972-Hunt et al (1960)
U.S. Pat. No. 2,981,904-Ajoika et al (1961)
U.S. Pat. No. 3,157,854-White (1964)
U.S. Pat. No. 3,528,041-Honda et al (1970)
U.S. Pat. No. 3,725,824-McDonald (1973)
U.S. Pat. No. 3,995,238-Knox et al (1976)

Hunt et al provides a waveguide phase inverter where input from a rectangular waveguide having the E field oriented in one dimension is output to another rectangular waveguide port with the E field disposed in the opposite direction (i.e. a 180° relative spatial reorientation). The inverter internally involves a gradual transition from rectangular to ridged waveguide and back again but does not appear to employ any intermediate TEM parallel transmission line section, non-resonant cavity or the like. In addition, the relative dimensions of the Hunt et al device would appear to be relatively long in the electrical sense.

White specifically provides a transition between rectangular and ridged waveguide structures. However, this is achieved with rather straight forward multi-step quarter wavelength transformers which collectively require a relatively long electrical distance to achieve the transition and, in any event, do not simultaneously achieve spatial reorientation of the electromagnetic field vectors.

The remaining patents to Ajoika et al, Honda et al, Knox et al and McDonald illustrate various other waveguide transition devices which may use tapered sections, wall and/or impedance matching "buttons" or the like.

Accordingly, none of these prior art structures provide an optimum solution for feeding closely packed individual radiators of a phased array with the H-plane oriented parallel to the dimension of closest inter-element spacing while yet permitting ready transition to differently oriented conventional rectangular waveguide structures.

These as well as other objects and advantages of this invention will be more completely appreciated and understood by carefully reading the following detailed description of a presently preferred embodiment of the invention, taking in conjunction with the accompanying drawings:

FIG. 1 is a schematic top view of a portion of the closely packed feed arrangement for individual radiators within a phased array using a transition from ridged waveguide to rectangular waveguide in accordance with this invention; and FIGS. 2–8 are drawings of an exemplary embodiment of an adaptor suitable for use in the system of FIG. 1 wherein FIGS. 2 and 3 are perspective views of opposite input/output port sides of the adaptor (partially cut away in the case of FIG. 2), FIGS. 4 and 5 are elevational views of the input/output port sides of the embodiment shown in FIGS. 2 and 3 and FIGS. 6–8 are cross-sectional views taken along the indicated section lines as shown in FIGS. 4 and 5.

A small area of a phased array 10 is schematically depicted in FIG. 1 in a view from the top. It is assumed that a series of individual radiators 12 must be located with inter-element spacing on the order of about one-half wavelength as depicted in FIG. 1. It is further assumed that each of the radiating structures 12 is to be fed with electromagnetic radiation having the H-plane oriented parallel to the dimension of closest inter-element spacing (i.e., vertically as shown in FIG. 1). To achieve waveguide feeding of such closely spaced radiator elements 12, ridged waveguide 14 is employed because it will fit within the close packed available space. Subsequently, a transition or adaptor 100 is employed (as shown in FIGS. 2–8) to transition to a conventional rectangular waveguide structure 16 disposed thereunder and having its long or H-plane dimension spatially oriented at 90° relative to that of the ridged waveguide 14.

The exemplary adaptor 100 is depicted in more detail at FIGS. 2–8. It includes a ridged waveguide input/output port 14 on one side and a rectangular waveguide input/output port 16 on the other side. In between, is a relatively short (e.g., on the order of $\frac{1}{8}$th to $\frac{1}{4}$th wavelength) non-resonant cavity 20 interconnecting the two opposing and spatially rotated input/output ports 14, 16. This non-resonant cavity 20 may, for example, be formed by machining a cavity within a metallic block 22 and then closing the top side of that cavity with an electrically and mechanically connected metallic plate 24.

Extending across the non-resonant cavity are tapered walls 26, 28 which constitute continuations of the central ridged waveguide walls. As shown in FIGS. 2–8, tapered ridged waveguide wall extension 26 tapers upwardly and connects with the upper broad wall of the rectangular I/0 waveguide port 16 while the opposing tapered wall extension 28 tapers downwardly and connects with the lower broad side wall of the rectangular waveguide I/0 port 16. These oppositely tapered walls 26, 28 are believed to constitute a form of parallel transmission line supporting TEM electromagnetic wave propagation. A conventional empirically adjusted impedance matching "button" 30 (or a pair of same) is employed in conjunction with this short length of parallel transmission line.

In addition, conventional empirically adjusted impedance matching pegs on buttons 32, 34 may also be employed across the rectangular waveguide I/0 port 16 so as to achieve optimal impedance matching and minimum VSWR.

As will be understood by those in the art, the adaptor of FIGS. 2–8 is a reciprocal device which can freely propagate microwave RF energy in either direction. The relative orientations of E and H field vectors for the rectangular and ridged waveguide sections is generally shown in FIGS. 2–8.

As should also be appreciated, the exact slope of the tapered wall extensions 26, 28 may be changed depending upon the specific desired dimensions at hand. In addition, the transition from the wide end to the narrow end (attached to the rectangular waveguide port) need not be continuous or smooth, but, alternatively, could include stepped transitions as should be appreciated.

Mounting holes 60, 62, 64 and 66 may be conveniently employed for mounting the twist adaptor 100 of FIGS. 2–8 into place with conventional rectangular/-ridged waveguide structures while location holes 68 and 70 may also be employed to ensure proper orientation of the assembled devices. Screws 72, 74 (or other conventional electrical/mechanical fastening arrangements) may be used for affixing plate 24 to the body 22. The tapered wall extensions 26, 28 typically may be formed as part of plate 24 and/or soldered or otherwise mechanically and electrically connected between the ridged waveguide I/0 port 14 and the rectangular waveguide I/0 port 16 as will be apparent to those in the art. The adaptor may also be formed in one piece by investment or other casting techniques.

Typically, in operation, a $TE_{10}$ mode wave propagating into one of the I/0 ports 14, 16 is briefly propagated in a TEM mode across a short nonresonant cavity 20 via parallel transmission line structures 26, 28 and then passes from the opposite I/0 port as a $TE_{10}$ mode wave but with the electric and magnetic field vectors rotated by 90°. As will be appreciated, the novel design features embodied in this arrangement may be employed to achieve different desired degrees of spatil rotation, if any, between the opposing rectangular/ridged waveguide I/0 ports.

In one embodiment, the adaptor may be designed to operate in the range of 10 Ghz while having an overall width of only about 1.5 inches and a height of only about $\frac{5}{8}$ inch and a thickness of approximately 7/16 inch. Conventional conductive waveguide metals and finishes may be employed.

The adaptor as described may provide an input VSWR of about 2 to 1 over a very broadband while, over a somewhat narrower band (e.g. 10% bandwidth) the input VSWR can be reduced to a value on the order of 1.1 e.g., by adjusting the empirically determined impedance matching elements 26, 32 and 34.

Although only one exemplary embodiment of this invention has been described in detail, those skilled in the art will recognize that many modifications and variations may be made in this exemplary embodiment while yet retaining many of the novel features and advantages of the invention. Accordingly, the appended claims are intended to cover all such modifications and variations.

What is claimed is:

1. A microwave waveguide adaptor comprising:

a rectangular waveguide input/output port;

a ridged waveguide input/output port;

a non-resonant cavity disposed between and physically connecting said input/output ports; and a parallel plate conductor TEM transmission line structure passing through said non-resonant cavity while remaining electrically separated from walls of the cavity and electrically interconnecting said input/output ports.

2. A microwave waveguide adaptor comprising:

a rectangular waveguide input/output port;

a ridged waveguide input/output port;

a non-resonant cavity disposed between and physically connecting said input/output ports; and a parallel conductor transmission line structure passing through said non-resonant cavity and electrically interconnecting said input/output ports;

wherein said input/output ports each have respective E and H plane dimensions and wherein the E-plane dimension of one port is oriented differently than the E-plane dimension of the other port.

3. A microwave waveguide adaptor as in claim 2 wherein:

said rectangular waveguide input/output port comprises a rectangular-shaped aperture in a first metallic member and has its longest dimension oriented in a first direction;

said ridged waveguide input/output port comprises an I-shaped aperture in a second metallic member and has its longest dimension oriented in a second direction transverse to said first direction;

said first and second metallic members being mechanically coupled together to include an enclosed metallic cavity therebetween to act as said non-resonant cavity; and said parallel conductor transmission line structure comprises a continuation of an opposing pair of parallel walls in the ridged port, said pair of walls being oppositely tapered in dimension toward connecting points on a respectively corresponding opposing pair of parallel walls in the rectangular port.

4. A microwave waveguide adaptor as in claim 3 wherein the length of said non-resonant cavity and of said parallel conductor transmission line is no more than about one-fourth wavelength and further comprising:

first impedance-matching means affixed to said parallel conductor transmission line structure; and second impedance-matching means affixed to said rectangular input/output port.

5. An array of plural microwave waveguide adaptors as in claim 3, said adaptors being spaced apart no more than approximately one-half wavelength center-to-center with the H-plane of the ridged ports being aligned with such inter-element spacing dimension, and each of said adaptors further comprising:

a microwave RF antenna radiating element in RF communication with the ridged port; and a rectangular waveguide, having its Eplane aligned with said inter-element spacing dimension, in RF communication with the rectangular port.

6. A microwave waveguide adaptor comprising:

a first metallic structure having an opened cavity therewithin of a length substantially less than one wavelength and a rectangular aperture through one wall of the cavity;

a second metallic structure having an I-shaped aperture therein and tapered continuations of the most closely spaced walls of the I-shaped aperture extending therefrom;

said first and second metallic structures being mechanically and electrically affixed together;

said second structure electrically closing said opened cavity except for said aperture; and said tapered wall continuations extending through and across the length of said cavity as a parallel conductor TEM transmission line while remaining electrically separated from walls of the cavity and with narrowed ends thereof being respectively connected to opposing ones of the most closely spaced walls of the rectangular aperture.

7. A microwave waveguide adaptor as in claim 6 further comprising:

at least one protrusion extending from one of said tapered walls towards the other tapered wall and sized to provide a matched RF impedance therewith.

8. A microwave waveguide adaptor as in claim 7 further comprising:

at least one protrusion extending from one of the most closely spaced walls of the rectangular aperture towards the other wall thereof and sized to provide matched RF impedance therewith.

9. A microwave waveguide adaptor as in claim 6 further comprising:

at least one protrusion extending from one of the most closely spaced walls of the rectangular aperture towards the other wall thereof and sized to provide matched RF impedance therewith.

10. A microwave waveguide adaptor comprising:

a first metallic structure having an opened cavity therewithin and a rectangular aperture through one wall of the cavity;

a second metallic structure having an I-shaped aperture therein and tapered continuations of the most closely spaced walls of the I-shaped aperture extending therefrom;

said first and second metallic structures being mechanically and electrically affixed together;

said second structure electrically closing said opened cavity except for said aperture; and said tapered wall continuations extending through and across said cavity with narrowed ends thereof being respectively connected to opposing ones of the most closely spaced walls of the rectangular aperture;

wherein the distance between said apertures is no more than about one-fourth wavelength of the RF fields to be propagated therethrough.

11. A microwave adaptor for coupling RF energy travelling in one form of waveguide to RF energy travelling in another form of waveguide, said adaptor comprising:

a first waveguide I/0 port having an E-plane disposed between first and second walls;

a second waveguide I/0 port having a E-plane disposed between third and fourth walls;

an electrically short, non-resonant, cavity located between said first and said second waveguide I/0 ports having a length substantially less than one wavelength; and a pair of tapered walls extending from said first waveguide I/0 port to said second waveguide I/0 port through said cavity while remaining out of contact with conductive walls defining said cavity for coupling RF energy in a parallel conductor transmission line TEM mode from one of said waveguide I/0 ports to the other of said waveguide I/0 ports along said tapered walls, each of said tapered walls having a narrow end and a wide end, said wide ends being coupled to said first and second walls of said first waveguide I/0 port, respectively, and said narrow ends being coupled to said third and said fourth walls of said second waveguide I/0 port, respectively, thereby providing a balanced parallel conductor TEM transmission line between said first waveguide I/0 port and said second waveguide I/0 port.

12. An adaptor as in claim 11 further comprising an impedance matching element located on at least one of said tapered walls.

13. An adaptor as in claim 12 further comprising an impedance matching element located on at least one of said third and said fourth walls.

14. An adaptor as in claim 13 wherein said second waveguide I/0 port is of the rectangular type.

15. An adaptor as in claim 14 wherein said first waveguide I/0 port is the ridged waveguide type.

16. An adaptor as in claim 11 wherein said second waveguide I/0 port is of the rectangular waveguide type.

17. An adaptor as in claim 11 wherein said first waveguide I/0 port is of the ridged waveguide type.

18. An adaptor as in claim 11 wherein said first waveguide I/0 port is of the ridged waveguide type and said second waveguide I/0 port is of the rectangular waveguide type.

19. An adaptor as in claim 11 wherein each of said tapered walls is generally the shape of a right triangle.

20. An adaptor as in claim 11 wherein each of said tapered walls has a sloped surface.

21. A microwave twist adaptor for coupling RF energy in one form of waveguide to another form of waveguide while imparting a spatial rotation to a longest dimension of the plane of the waveguide, said adaptor comprising:

a first waveguide I/0 port having a first and second wall formed therein and adapted to connect to a first waveguide type wherein the E-field of RF travelling in the first waveguide extends between said first and second walls;

a second waveguide I/0 port having a third and a fourth wall formed therein and adapted to connect to a second waveguide type wherein the E-field of RF travelling in the second waveguide extends between said third and fourth walls;

a non-resonant cavity formed by conductive walls between said first and second waveguide I/0 ports; and a pair of parallel conductive tapered walls extending between said first and second waveguide I/0 ports without contacting the cavity walls for coupling RF energy from one of said I/0 ports to the other of said I/0 ports in a parallel conductor transmission line TEM mode, while changing the spatial orientation between said E-fields of the first waveguide and second waveguides respectively, each of said tapered walls having a wide end and a narrow end, a wide end of a first tapered wall being coupled to said first wall and a wide end of the second tapered wall being coupled to said second wall, the narrow end of said first tapered wall being coupled to said third wall and the narrow end of said second tapered wall being coupled to said fourth wall.

22. An adaptor as in claim 21 wherein said change in orientation is about 90 degrees.

23. An adaptor as in claim 22 wherein said first waveguide I/0 port is of the ridged waveguide type and said second waveguide type I/0 port is of the rectangular waveguide type.

24. An adaptor as in claim 21 further comprising a plurality of impedance matching elements in the form of protrusions located within said microwave twist adaptor.

25. An adaptor as in claim 21 wherein said adaptor comprises two plates; a first plate including said first waveguide I/0 port and said tapered walls, and a second plate including said second waveguide I/0 port and said cavity therewithin.

26. A microwave twist adaptor for coupling RF energy between a ridged waveguide and a rectangular waveguide and for simultaneously imparting a 90 degree spatial twist thereto, said adaptor comprising:

a ridged waveguide I/0 port adapted to couple to a ridged waveguide and having a first and second wall between which the E-field of said RF energy extends;

a rectangular waveguide I/0 port adapted to couple to a rectangular waveguide and having a third and fourth wall between which the E-field of said RF energy extends;

an enclosed non-resonant cavity defined by conductive walls and extending between said rectangular waveguide I/0 port and said ridged waveguide I/0 port; and tapered wall means defining a parallel conductor TEM transmission line located within a central portion of said cavity and unconnected with the cavity walls for coupling RF energy between the ridged waveguide and the rectangular waveguide through said cavity, said tapered wall means including a pair of elements each being of a generally triangular shape, one of said elements extending between a top wall of said rectangular waveguide and a wall of said ridged waveguide, and a second element extending between a bottom wall of said rectangular waveguide and another wall of said ridged waveguide, said elements carrying RF energy in a parallel transmission line TEM mode.

* * * * *